US007788836B2

(12) United States Patent
Vincent

(10) Patent No.: US 7,788,836 B2
(45) Date of Patent: Sep. 7, 2010

(54) DEVICE AND METHOD FOR HANGING PHOTOGRAPHS OR CARDS

(75) Inventor: Thomas Vincent, Mill Valley, CA (US)

(73) Assignee: Umbra LLC, Buffalo, NY (US)

( * ) Notice: Subject to any disclaimer, the term of this patent is extended or adjusted under 35 U.S.C. 154(b) by 670 days.

(21) Appl. No.: 11/248,400

(22) Filed: Oct. 12, 2005

(65) Prior Publication Data

US 2007/0084098 A1 Apr. 19, 2007

(51) Int. Cl.
*G09F 15/00* (2006.01)

(52) U.S. Cl. ..... 40/607.11; 40/617; 211/45; 211/205; 248/469

(58) Field of Classification Search ..... 40/607.11, 40/657, 666, 757, 744, 780, 124, 647, 607.1, 40/607.12, 617, 1; D6/301–302; 211/45, 211/196, 205; 446/227; 248/468–470, 489
See application file for complete search history.

(56) References Cited

U.S. PATENT DOCUMENTS

| | | | | | |
|---|---|---|---|---|---|
| 2,143,343 | A | | 1/1939 | Cooper | |
| 2,432,957 | A | | 12/1947 | Webster | |
| 2,994,156 | A | | 8/1961 | Steiner et al. | |
| D227,848 | S | * | 7/1973 | Schneider | D6/301 |
| 4,319,731 | A | | 3/1982 | Pfeifer | |
| D273,312 | S | * | 4/1984 | Guertin | D21/337 |
| D277,584 | S | | 2/1985 | Annestedt | |
| 4,650,422 | A | | 3/1987 | Gorczynski | |
| 5,246,374 | A | | 9/1993 | Boodram | |
| 5,280,840 | A | | 1/1994 | Terpening | |
| 5,358,246 | A | | 10/1994 | Dziedzic | |
| 5,480,036 | A | | 1/1996 | Opar | |
| D377,668 | S | | 1/1997 | Biram et al. | |
| D444,633 | S | * | 7/2001 | Henick | D6/301 |
| 6,349,940 | B1 | | 2/2002 | Nimry | |
| D459,898 | S | * | 7/2002 | Sanford | D6/302 |
| D460,273 | S | | 7/2002 | Henick | |
| 6,524,108 | B2 | | 2/2003 | Murray | |
| D474,616 | S | * | 5/2003 | Henick | D6/302 |
| D474,899 | S | * | 5/2003 | Henick | D6/301 |
| D479,654 | S | * | 9/2003 | Henick | D6/301 |
| D479,772 | S | * | 9/2003 | Henick | D6/301 |
| 6,698,598 | B1 | | 3/2004 | Appenteng | |

(Continued)

FOREIGN PATENT DOCUMENTS

| | | |
|---|---|---|
| DE | 20302963 | 5/2003 |

(Continued)

*Primary Examiner*—William L. Miller
(74) *Attorney, Agent, or Firm*—Simpson & Simpson, PLLC

(57) ABSTRACT

The invention broadly comprises a device for displaying an object including a stand, at least one arcuate hanger element connected to the stand, and a fastener connected to the at least one arcuate hanger element. In some aspects, the at least one hanger element is symmetrically arranged with respect to the stand. In some aspects, the at least one hanger element comprises a length and at least two hanger elements in the at least one hanger element have different respective lengths. In some aspects, the at least one hanger element is flexible. In some aspects, the at least one hanger element is wire. The at least one hanger element comprises a distal end and the fastener is connected to the distal end. In some aspects, the fastener is a clip.

14 Claims, 4 Drawing Sheets

U.S. PATENT DOCUMENTS

| | | | |
|---|---|---|---|
| D502,223 | S | 2/2005 | Kaplan et al. |
| 6,854,609 | B1 | 2/2005 | Hettinger |
| 7,523,574 | B2 | 4/2009 | Henick et al. |
| 2005/0178036 | A1 | 8/2005 | Henick et al. |

FOREIGN PATENT DOCUMENTS

| | | |
|---|---|---|
| GB | 960760 | 6/1964 |
| WO | WO 98/16440 | 4/1998 |

* cited by examiner

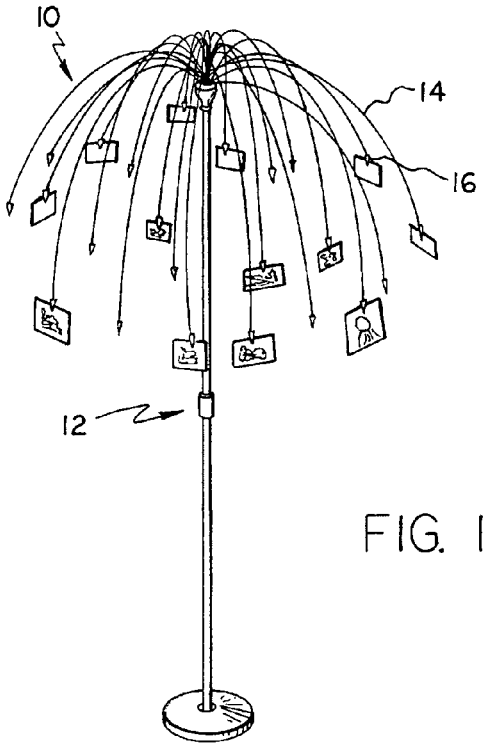
FIG. 1
FIG. 3
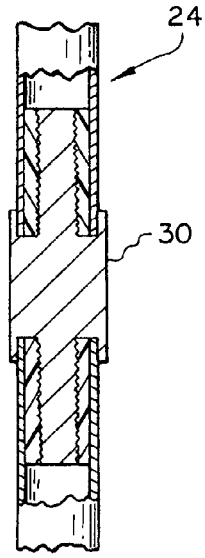
FIG. 6
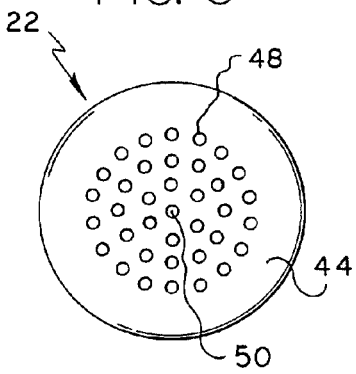
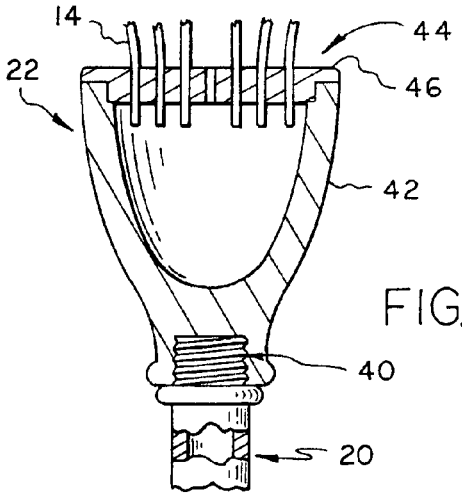
FIG. 5

FIG. 4
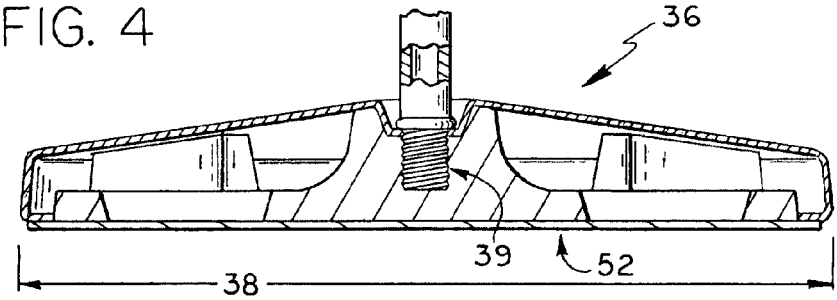
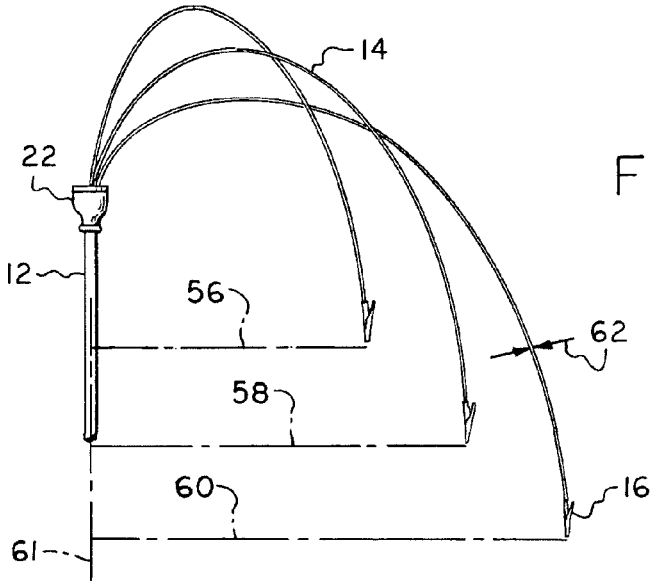
FIG. 7
FIG. 8
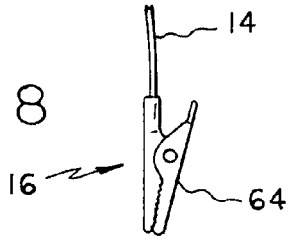

DEVICE AND METHOD FOR HANGING PHOTOGRAPHS OR CARDS

FIELD OF THE INVENTION

The invention relates generally to devices for displaying objects such as photographs and cards. In particular, the invention relates to a stand with a plurality of arcuate hanger elements radiating from the stand with fasteners for grasping photographs and cards on the ends of the hanger elements.

BACKGROUND OF THE INVENTION

It is known to display photographs or cards from a stand. For example, U.S. Design Pat. No. D460,273 (Hennick) teaches a free-standing mobile/stand having a plurality of curved metal arcs from which photographs can be hung. Unfortunately, the stand and the arcs are integral, that is, each respective arc is a continuation of a vertical piece which is a continuation of a piece forming the base of Hennick's unit. This "unibody" construction limits the number of arc units than can be reasonably deployed (Hennick shows only six). This in turn limits the number of photographs that can be displayed. The "unibody" construction also results in a rather heavy and awkward device. Also, Hennick shows photographs hanging from the ends of the arcs. Unfortunately, this is a rather specialized arrangement. For example, it appears that special holders with special chain attaching means are needed. Thus, it appears to be difficult for a user to easily change the items being displayed.

U.S. Pat. No. 6,349,940 Nimry teaches a device for holding game cards. Unfortunately, Nimry's device is arranged to show cards only in one direction, is not meant for display purposes, and holds a rather small number of cards. In short, Nimry is not intended to or suitable for displaying photographs or other types of cards. U.S. Pat. No. 5,246,374 (Boodram) teaches a family tree display. This display is very specialized and requires special "branches" and special picture holders. Boodram is only intended to show genealogically related photographs and is not intended to or suitable for the general display of photographs and cards.

Thus, there is a long-felt need to provide a device for displaying photographs and cards that allows a user to display a large number of photographs and cards, to easily and quickly add or remove photographs and cards from the device, is well-adapted for general use, does not require specialized pieces to hang the photographs and cards, and engenders a graceful and aesthetically pleasing presentation.

SUMMARY OF THE INVENTION

The invention broadly comprises a device for displaying an object including a stand, at least one arcuate hanger element connected to the stand, and a fastener connected to the at least one arcuate hanger element. The stand includes an upright member and a head. The at least one hanger element is connected to the head. In some aspects, the head is removably attached to the upright member.

In some aspects, the upright member further comprises a base with a bottom surface, the head further comprises a top surface substantially co-planar with the bottom surface, and the at least one hanger element is connected to the top surface. In some aspects, the at least one hanger element is symmetrically arranged with respect to the stand. In some aspects, the at least one hanger element comprises a length and at least two hanger elements in the at least one hanger element have different respective lengths.

In some aspects, the at least one hanger element is flexible. In some aspects, the at least one hanger element is wire. The at least one hanger element comprises a distal end and the fastener is connected to the distal end. In some aspects, the fastener is a clip.

It is a general object of the present invention to provide a device for displaying photographs and cards that allows a user to display a large number of photographs and cards and to easily and quickly add or remove photographs or cards.

It is another object of the present invention to provide a device for displaying photographs and cards that is well-adapted for general use and does not require specialized pieces to hang the photographs and cards.

It is still another object of the present invention to provide a device for displaying photographs and cards that engenders a graceful and aesthetically pleasing presentation.

These and other objects and advantages of the present invention will be readily appreciable from the following description of preferred embodiments of the invention and from the accompanying drawings and claims.

BRIEF DESCRIPTION OF THE DRAWINGS

FIG. 1 is a prospective view of a present invention device for displaying an object;

FIG. 3 is a detail of the post in FIG. 2;

FIG. 4 is a detail of the base in FIG. 2;

FIG. 5 is a side view of the head shown in FIG. 2;

FIG. 6 is a top view of the head shown in FIG. 2;

FIG. 7 is a detail of the hanging elements shown in FIG. 2;

FIG. 8 is a detail of the fastener shown in FIG. 2;

DETAILED DESCRIPTION OF THE PREFERRED EMBODIMENT

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

FIG. 1 is a prospective view of present invention device 10 for displaying an object.

Figure 2:
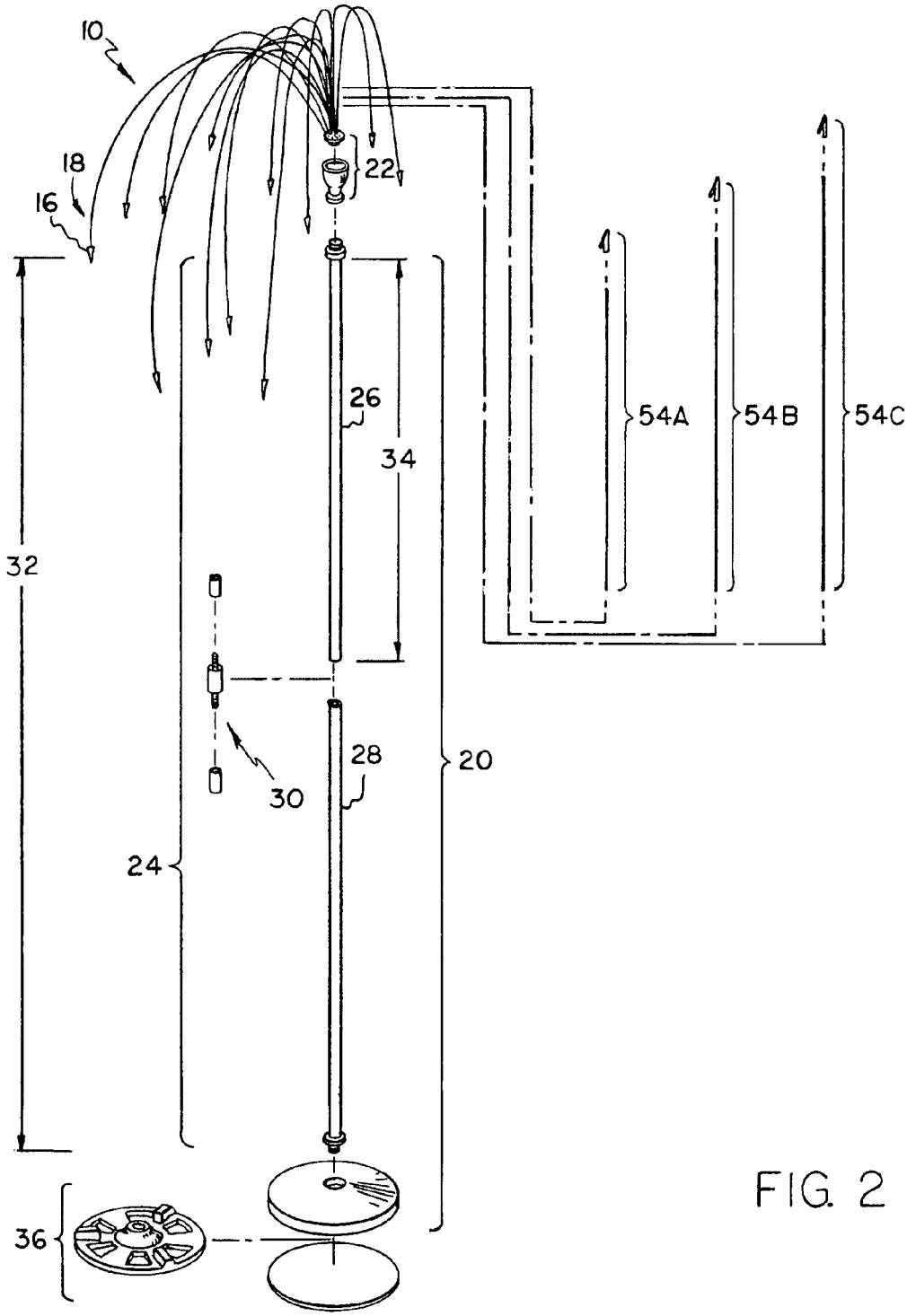
FIG. 2 is an exploded view of the device in FIG. 1.
Figure 9:
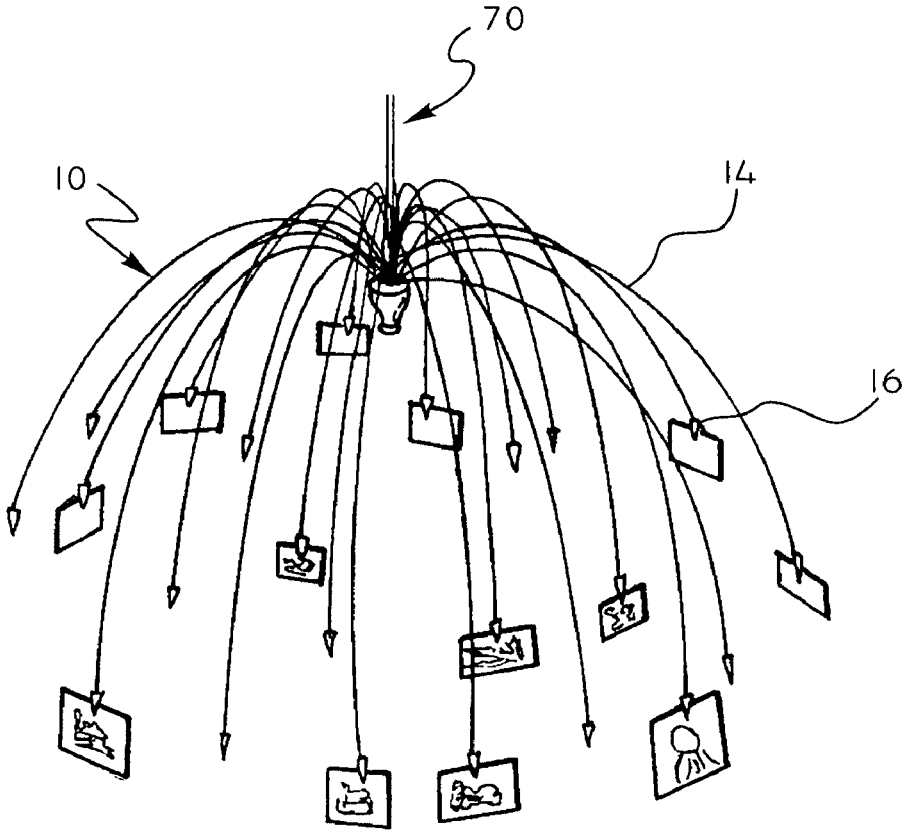
FIG. 9 is a prospective view of an embodiment of a present invention device for displaying an object; and, FIG. 10 is a side view of the head shown in FIG. 9.
Figure 10:
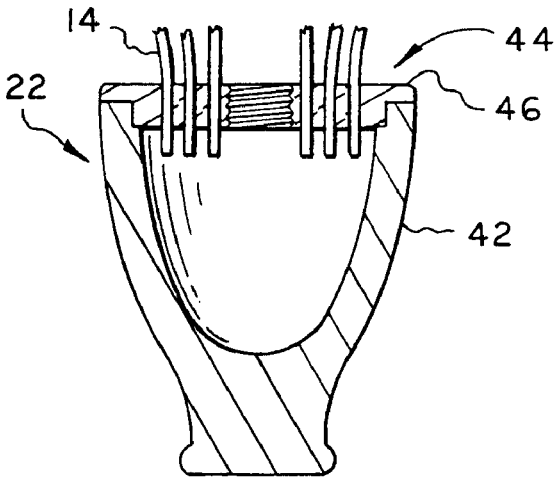

FIG. 2 is an exploded view of device 10 in FIG. 1. The following should be viewed in light of FIGS. 1 and 2. Device 10 includes stand 12 and at least one hanger element 14. Device 10 is not limited to any particular number of elements 14. Elements 14 have an arcuate or curved shape. Fasteners 16 are connected to the distal ends 18 of elements 14. Stand 12 includes upright member 20 and head 22. Elements 14 are connected to head 22. Member 20 and head 22 can be made of any material or combination of materials known in the art. In some aspects member 20 and/or head 22 are spun or stamped metal. Any finish known in the art can be applied to member 20 and head 22.

FIG. 3 is a detail of post 24. The following should be viewed in light of FIGS. 1-3. Member 20 includes post 24. Post 24 can be solid or hollow. In some aspects, post 24 is modular. For example, FIG. 3 shows parts 26 and 28 joined by connector 30. It should be understood that post 24 is not limited to any particular number or configuration of component parts and connectors. It also should be understood that any means known in the art can be used for connector 30. Length 32 of post 24 can be varied. For example, if device 10 is to rest on a floor, length 32 can be longer, and if device 10 is to rest on a table, desk, etc., length 32 can be made shorter. For those aspects in which post 24 has multiple parts, the lengths of those parts, for example, length 34 of part 26, can be varied.

FIG. 4 is a detail of base 36. The following should be viewed in light of FIGS. 1-4. Base 36 is generally arranged to rest upon a horizontal surface such as a floor or table top and to provide a stable base for device 10. Diameter 38 can be varied and the weight and/or weight distribution of base 36 can be varied. In some aspects, post 24 is removably connected to base 36. Any method known in the art, for example, threaded connection 39, can be used to join post 24 and base 36. In some aspects (not shown), post 24 is fixedly attached to base 36.

FIG. 5 is a side view of head 22.

FIG. 6 is a top view of head 22. The following should be viewed in light of FIGS. 1-6. In some aspects (not shown), head 22 is fixedly attached to member 20, or is integral to member 20. In some aspects, head 22 is removably connected to member 20. Any method known in the art, for example, threaded connection 40 shown in FIG. 5, can be used to removably join member 20 and head 22. In some aspects, head 22 includes body 42 with top surface 44. Elements 14 are connected to surface 44. In some aspects, body 42 includes cap 46. Cap 46 can be integral to body 42 (not shown) or can be a separate piece connected to cap 46. Surface 44 includes openings 48. Elements 14 are fastened to cap 46 using openings 48. Any means known in the art can be used to fasten elements 14 using openings 48. For example, the openings and respective elements can be complementarily threaded, the elements can be soldered to the cap, or the elements may have a friction fit with respect to the openings. In some aspects, elements 14 are arranged symmetrically with respect to stand 12. For example, openings 48 are arranged symmetrically in cap 46, for example, about center point 50. In FIGS. 1 and 2, openings 48 are configured in concentric circles about point 50. However, it should be understood that other configurations of openings 48 are included in the spirit and scope of the claims. In some aspects, top surface 42 is substantially co-planar with bottom surface 52 of base 36. This co-planar configuration and the configuration of openings 48 gives rise to a fountain-like shape for elements 14.

FIG. 7 is a detail of elements 14 shown in FIG. 2. The following should be viewed in light of FIGS. 1-7. Each element 14 has a length 54. In some aspects, elements 14 have one of three lengths 54, lengths 54A, 54B, and 54C as shown in FIG. 2. However, it should be understood that the present invention is not limited to any particular combination of length 54 or lengths 54 and that any such combination is included in the spirit and scope of the claims. For example, elements 14 can have a same length 54, can have one of two lengths 54, or can have one of more than three lengths 54. By varying lengths 54, the disposition of the associated connectors 16 can be controlled and a desired effect created. For example, levels 56, 58, and 60 in FIG. 7, measured with respect to axis 61, are created by the lengths shown in FIGS. 2 and 7.

In some aspects, hanger elements 14 are flexible and the arcuate shape of elements 14 is due to the bending of elements 14 by gravity. In some aspects (not shown), elements 14 are relatively rigid. In cross-section (not shown) elements 14 can have any shape known in the art. In general, a cross-section is circular, but it should be understood that other cross-sectional shapes are included in the spirit and scope of the claims. In some aspects, elements 14 are tubular (hollow). In some aspects, elements 14 are wire. In some aspects, elements 14 are made of a flexible metal or plastic rod. Diameter 62 of elements 14 can be selected in accordance with the properties of the material forming elements 14 and the desired shape of elements 14. For example, decreasing diameter 62 generally increases the curvature of elements 14 for those aspects with flexible elements 14 and would vary the location of levels 56, 58, and 60.

FIG. 8 is a detail of fastener 16 shown in FIG. 2. The following should be viewed in light of FIGS. 1-8. In some aspects, fastener 16 is a clip, for example, alligator clip 64. However, it should be understood that other types of fasteners are included in the spirit and scope of the claims. In general, fastener 16 is selected for ease of use by a person using device 10. In some aspects, fastener 16 is configured to grasp a photograph or a piece of paper, such as a postcard or a greeting card. However, it should be understood that fastener 16 can be used to grasp other objects and the suitability of such objects is generally with respect to a size, shape, or weight of such objects or a desired use of the device 10. For example (not shown), device 10 can be used to hold multi-media art objects.

In some aspects, device 10 is configured for a chandelier application. That is, rather than being supported on stand 12, head 22 is arranged to receive hanging member 70 from which head 22 is suspended or hung in space. In some aspects, point 50 is a hole or other means for connecting head 22 to hanging member 70, for example a rod or flexible element such as a cord or chain. In these aspects, point 50 can be a threaded hole, a hook, an eyelet, or any other means known in the art. In some aspects (not shown), other or multiple points on head 22 are configured for receiving a hanging member.

Thus, it is seen that the objects of the invention are efficiently obtained, although changes and modifications to the invention should be readily apparent to those having ordinary skill in the art, without departing from the spirit or scope of the invention as claimed. Although the invention is described by reference to a specific preferred embodiment, it is clear that variations can be made without departing from the scope or spirit of the invention as claimed.

What is claimed is:

1. A device for displaying an object, comprising:

a stand including a base and a single straight non-arcuate post, the single straight non-arcuate post extending substantially orthogonally from the base and including a first end connectable to the base and a second end, the second end of the post opposite the first end of the post;

a head with a first end, connectable to the second end of the single straight non-arcuate post, and a top side, opposite the first end of the head and facing away from the first end of the head;

a plurality of flexible arcuate hanger elements, wherein each flexible arcuate hanger element in the plurality of flexible arcuate hanger elements is a separate piece from the remaining flexible arcuate hanger elements in the plurality of flexible arcuate hanger elements and wherein said each flexible arcuate hanger element includes a respective first end connected to the top side; and, a respective fastener connected to a respective second end of said each flexible arcuate hanger element in the plurality of flexible arcuate hanger elements.

2. The device recited in claim 1 wherein said head is removably attached to said single straight non-arcuate post.

3. The device recited in claim 1 wherein said base comprises a bottom surface, and said top side is substantially parallel to said bottom surface.

4. The device recited in claim 1 wherein the plurality of arcuate hanger elements is symmetrically arranged with respect to said stand.

5. The device recited in claim 1 wherein said each arcuate hanger element comprises a respective first hanger element with a respective first length and a respective second hanger element with a respective second length different than the respective first length.

6. The device recited in claim 1 wherein said each arcuate hanger element is wire.

7. The device recited in claim 1 wherein said respective fastener is a clip.

8. A method for displaying a plurality of objects, comprising:

connecting a first end of a single straight non-arcuate post to a base for a stand;

connecting a second end of the single straight non-arcuate post to a first end of a head, the second end of the post opposite the first end of the post, wherein the head includes a top side, opposite the first end of the head and facing away from the first end of the head;

connecting a respective first end for each flexible arcuate hanger element from a plurality of flexible arcuate hanger elements to said top side, wherein said each flexible arcuate hanger element is a separate piece from the remaining flexible arcuate hanger elements in the plurality of flexible arcuate hanger elements; and, connecting a respective fastener to a respective second end of said each flexible arcuate hanger element, the respective fastener arranged to grasp a respective object from the plurality of objects.

9. The method of claim 8 wherein said base comprises a bottom surface, and wherein said top side is substantially parallel to said bottom surface.

10. The method of claim 8 wherein said each arcuate hanger element comprises a respective first hanger element with a respective first length and a respective second hanger element with a respective second length different than the respective first length.

11. The method of claim 8 wherein said each arcuate hanger element is wire.

12. The method of claim 8 wherein said respective fastener is a clip.

13. A device for displaying an object, comprising:

a stand including a base and a single straight non-arcuate post, the single straight non-arcuate post extending substantially orthogonally from the base and including a first end connectable to the base;

a head connectable to a second end of the single straight non-arcuate post, the second end opposite the first end;

a plurality of arcuate hanger elements, wherein each arcuate hanger element in the plurality of arcuate hanger elements is a separate piece from the remaining arcuate hanger elements in the plurality of arcuate hanger elements and wherein said each arcuate hanger element includes a respective first end connected to the head; and, a respective fastener connected to a respective second end of said each arcuate hanger element in the plurality of arcuate hanger elements, wherein said base comprises a bottom surface, said head further comprises a top side substantially parallel to said bottom surface, and said each arcuate hanger element is connected to said top side.

14. A method for displaying a plurality of objects, comprising:

connecting a first end of a single straight non-arcuate post to a base for a stand;

connecting a second end of the single straight non-arcuate post to a head, the second end opposite the first end;

connecting a respective first end for each arcuate hanger element from a plurality of arcuate hanger elements to said head, wherein said each arcuate hanger element is a separate piece from the remaining arcuate hanger elements in the plurality of arcuate hanger elements; and, connecting a respective fastener to a respective second end of said each arcuate hanger element, the respective fastener arranged to grasp a respective object from the plurality of objects, wherein said base comprises a bottom surface, said head further comprises a top side substantially parallel to said bottom surface and wherein connecting a respective first end of said each hanger element to said head further comprises connecting said each arcuate hanger element to said top side.

* * * * *